US005630353A

United States Patent [19]

Mittlefehldt et al.

[11] Patent Number: 5,630,353

[45] Date of Patent: May 20, 1997

[54] COMPRESSOR PISTON WITH A BASIC HOLLOW DESIGN

[75] Inventors: Kurt R. Mittlefehldt, Amherst; Daniel P. Kurbiel, East Amherst; Michael G. Thurston, Buffalo; David M. Ebbing, Clarence Center, all of N.Y.

[73] Assignee: General Motors Corporation, Detroit, Mich.

[21] Appl. No.: 665,276

[22] Filed: Jun. 17, 1996

[51] Int. Cl.[6] ..... F01B 3/00

[52] U.S. Cl. ..... 92/71; 92/172; 417/269

[58] Field of Search ..... 92/12.2, 71, 172; 417/269; 74/60; 91/499

[56] References Cited

U.S. PATENT DOCUMENTS

| | | | |
|---|---|---|---|
| 4,526,516 | 7/1985 | Swain et al. | 417/222 |
| 5,174,728 | 12/1992 | Kimura et al. | 417/222.2 |
| 5,304,042 | 4/1994 | Kayukawa et al. | 74/60 |
| 5,316,447 | 5/1994 | Fuji et al. | 417/269 |
| 5,364,232 | 11/1994 | Kimura et al. | 417/269 |
| 5,382,139 | 1/1995 | Kawaguchi et al. | 417/269 |
| 5,417,552 | 5/1995 | Kayukawa et al. | 417/269 |
| 5,461,967 | 10/1995 | Burkett et al. | 92/71 |

*Primary Examiner*—Thomas E. Denion
*Attorney, Agent, or Firm*—Patrick M. Griffin

[57] ABSTRACT

A swash plate piston (20) of integral, one piece design has outer surface portions in contact with much of the total available inner surface of the cylinder bore (18), but with a basically hollow design that can be easily manufactured. Outer (36) and inner (38) semi cylindrical segments of the piston (20) extend axially back from a cylindrical head (32), but leave the center of the piston body entirely open and empty. A slanted wing member (40) extends out and down from the inner segment (38), into the outer segment (36), creating a four sided, frame like structure of superior strength. All of the outboard outer surfaces of the piston (20) lie on the same cylindrical envelope as the cylinder bore (18) itself, giving good, even support. However, none of the outer surfaces, outboard or inboard, present any concavities that would jeopardize the ability to form the piston (20) with only two forming elements that part in a straight line.

3 Claims, 3 Drawing Sheets

COMPRESSOR PISTON WITH A BASIC HOLLOW DESIGN

This invention relates to a piston design for an automotive air conditioning compressor.

BACKGROUND OF THE INVENTION

Piston type automotive air conditioning compressors have a generally cylindrical cylinder block with a plurality of cylinder bores arrayed around, and parallel to, a central axis of the block. A piston in each cylinder bore is reciprocated back and forth by one of two main types of drive mechanisms, a wobble plate or a swash plate. Each drive mechanism is a plate that is driven about the axis of the cylinder block at a tilt angle or fixed angle of nutation so that the edge of the plate reciprocates axially back and forth relative to the pistons. When connected to the pistons, the pistons are correspondingly driven back and forth in their bores. Obviously, the piston to plate connection will have to allow relative slipping, since the pistons cannot rotate with the plate. In the case of a wobble plate, part of the plate itself is allowed to slip relative to another part of the plate, which is sometimes referred to as a slipper foot design. In the case of the swash plate, the plate is solid, and the edge of the plate slips through a pair of semi spherical bearings that ride in a socket at the back of the piston. The shape and manufacture of the piston is greatly affected by whether the drive mechanism is the wobble or swash plate type. In general, piston manufacture and design is significantly more difficult in the case of a swash plate, for reasons described below.

Before turning to the state of the current art in piston shape and manufacture, it is useful to turn to FIG. 8 of the drawings to get a general understanding of the framework within which a piston designer would work. As the piston moves in the bore, it's outer surface slides and rubs over the inner surface of the bore, and the two interfit closely. At or near top dead center, the piston is almost entirely inside the bore, and piston guidance, that is, the degree to which the piston axis is kept on the bore axis, is good. As the piston retracts, much of its outer surface is pulled out of the bore. At that point, other mechanisms have to be relied upon for piston guidance. Nevertheless, the piston designer is compelled to design a piston that has as much piston outer surface area in contact with as much of the bore inner surface as possible, or, at least, as much as is possible within the constraints of piston manufacturability and weight. Now, FIG. 8 schematically represents what may be thought of as a potential outer surface envelope for a theoretical piston, a piston which would be located at the lowermost or "6 o'clock) position in a compressor cylinder block that was cross section in a 12 o'clock-6 o'clock plane. The outer surface envelope represents the total surface area that can possibly be in contact with the bore, and breaks it down into six different portions. The front and back portions, F and B, are simple cylinders, which are significantly shorter than the total bore length, but with continuous outer surfaces that contact a total 360 degrees worth of the bore inner surface. The back portion B is not particularly significant to piston guidance in the cylinder bore per se, although it has implications for piston strength. The back portion B is simply not in the cylinder bore for very long in any given stroke, while the front portion F is always inside the bore. The rest of the potential envelope, which is the majority of it, is divided up into a semi cylindrical outer portion O, which would face radially outwardly of the cylinder block, an opposed semi cylindrical inner portion I, and two opposed semi cylindrical side portions S. Each of these portions may be conceived as subtending about 90 degrees. These are shown exploded out for purposes of illustration. In addition, a center axis A is indicated, as well as a central plane P that would run through A and bisect the inner and outer portions O and I. A double headed arrow indicates a direction perpendicular to A, moving through or toward the side portions. While this may seem over analytical, it provides a unique and novel framework for surveying and cataloging the myriad piston design approaches that have been taken to date, although the designers were not likely thinking consciously in terms of such a theoretical design framework at the time.

The simplest piston design of all would be no more that a solid cylindrical plug or head that corresponded to the front portion F. In fact, many old and current piston designs, in wobble plate compressors, are exactly that. This is possible because, in a wobble plate, the short piston head is connected to the slipper foot portion of the wobble plate by a thin rod with a spherical joint at each end. This simple piston shape can be easily turned on a lathe. A variation of this simple design may be seen in U.S. Pat. No. 4,526,516 to Swain et al. issued Jul. 2, 1985, where the piston has a short, solid head at the front, and a longer cylindrical skirt extending axially back from the head. A relatively thin center post is fixed to the slipper foot of the wobble plate with a spherical headed post. This piston design, too, can be lathe turned. It is substantially hollow, and therefore light, but has essentially the entire potential surface envelope presented to the bore. However, this type of piston design is not practical in a swash plate piston, as will be seen. Another possible approach is to put a forwardly extending sleeve or skirt extending forwardly of the piston head, rather than extending back, a design that could also be lathe turned. This, however, would require a greater total cylinder block length.

A swash plate piston presents unique manufacturing challenges that affect how much of, and how easily, the entire potential surface envelope of the piston can be used. A typical swash plate piston may be seen in co assigned U.S. Pat. No. 5,461,967 to Burkett et at. issued Oct. 31, 1995. As shown there, the piston 20 is integral and solid, but in terms of the surface envelope as defined above, it utilizes only the front portion F (that being the outer surface of the front end 34) and the outer portion O (called out as an outer surface 36). This piston 20 is more than just a front plug or head, but really adds only the outer surface 36 for extra cylinder bore contact. While much of the potential piston outer surface contact envelope is thus not utilized (most notably the inner portions I as defined above), it is not so important in the design disclosed, which has a unique piston control ring 42 to help guide the piston 20 and to make up for the absence of an inner portion I. Furthermore, the piston 20 at least has the advantage of being easily and relatively inexpensively manufactured, as well as being relatively light and low mass. While the patent does not speak a great deal to how the piston 20 would be manufactured, those skilled in the art will note that the shape of piston 20 is such that none of it's outer surfaces present a concavity, as seen in the direction of the arrow in FIG. 8, except for the ball socket, a non avoidable concavity which must be machined out in any piston of the same general type. Therefore, the rest of the piston body could be forged or east (at least to a near net shape) with only two dies or molds, which could move together or apart in the direction of the arrow in FIG. 8. Only final finish surface of the bore contact surfaces 34 and 36 (and of the ball socket) would be needed. At the far end of the spectrum, the piston design shown in U.S. Pat. No. 5,174,728 to Kimura et at. issued Dec. 29, 1992 utilizes the entire outer envelope, having a cylindrical body 12 with a complete, outer cylindrical surface that is closed at front and back, but which is entirely hollow. This is the most difficult and expensive design of all to manufacture, however, and must inevitably be formed of at least two pieces welded together, as a closed canister would be. The interior must also be vented to prevent pressure differentials from crushing the thin walled and hollow outer body.

In between the two piston design extremes of head only and two piece, hollow canister are other designs which attempt to keep a one piece integral structure, while retaining as much outer surface area as possible, but eliminating as much solid material volume as possible for weight reduction. These are competing purposes, obviously, and proposed designs fall short either by failing to provide critical piston outer surface portions, or by being very difficult to manufacture, or both. One such design is shown in U.S. Pat. No. 5,382,139 to Kawaguchi et al. issued Jan. 17, 1995, in which piston 9 is concave, as opposed to truly hollow, and is missing the entire outer surface portion O, being open at that area instead. The design also has an internal concavity in the head portion that would prevent it from being die east with only two mold halves, and which would require instead that the piston interior be either lost core east or internally machined out. In Japanese Laid Open patent application 7-189900, several variations of the same basic shown in the '139 patent. In FIG. 6 of the Japanese application, the piston body is concave, on either one or both sides, so as to eliminate weight, but this also eliminates any outer surface area on at least one side portion S. In most of the embodiments disclosed, outer surface area is absent on both of the side portions S defined in FIG. 8. One embodiment is completely asymmetrical, having surface area all on one side portion S only, and none on the other, giving a C shaped cross section. (See FIG. 6 of 7-189900) In addition to not having symmetrical support on both side portions S, the piston is, at best, concave, not truly hollow. That is, as viewed along the arrow of current FIG. 8, solid material would be seen, either on one side, as in FIG. 6, or in the middle, at a central web centered on the plane P. This is clearly not as light or mass efficient as a completely hollow design would be, that is, a design in which no solid piston body material was seen or encountered when moving along the arrow shown in FIG. 8.

SUMMARY OF THE INVENTION

A compressor piston in accordance with the present invention is characterised by the features specified in claim 1. The invention provides a piston design that is one piece and integral, yet truly hollow, as opposed to simply being concave on one side. It also provides partial utilization of the side portions of the piston envelope defined above, and does so symmetrically, on both side portions S evenly. The design can also be easily manufactured by a process using only two forming elements that move perpendicular to the central plane of the piston.

In the preferred embodiment disclosed, the piston has a solid cylindrical head, with a continuous outer surface that matches the cylinder bore diameter. The solid head, however, is relatively axially short, thereby having little weight, but also providing little surface area in contact with the bore. Extending axially back from the head is an outer cylindrical segment of constant width, the outboard outer surface of which lies on the outer surface portion O of the envelope. The radial thickness of the outer cylindrical segment is relatively small, and, in the embodiment disclosed, the inboard outer surface of the outer cylindrical segment is basically flat, so that the segment has a cross section that defines a chord and corresponding arc of the entire circle. Also extending axially back from the piston head is an inner cylindrical segment, diametrically opposed to the outer segment, and of similar width and thickness, but shorter axial length. An integral and symmetrical wing member extends axially of the piston. Preferably, in the embodiment disclosed, the wing member extends back from the end of the inner cylindrical segment at an angle, toward the outer cylindrical segment, and merges, indirectly, with the outer segment, for added strength. The radial thickness and cross sectional shape of the wing member is comparable to both the inner and outer segments of the piston, but its edge to edge width is not a constant. Instead, the side edges of the wing member diverge, because they lie on the side portions of the cylindrical outer envelope.

The configuration of the as described piston gives several operational and manufacturing advantages. Most visibly, the piston is truly hollow. That is, as viewed normal to the central plane, there is no material coincident with the side portions of the envelope, but for the side edges of the wing member. Therefore, the piston is light and low in mass and inertia. In addition, in the embodiment disclosed, the shape of the outer surfaces of every part of the piston (but for the ball sockets) is such that there are no concavities, as viewed normal to the central plane. Therefore, every outer surface of the piston, but for the ball socket itself, can be formed to at least a near net shape, by a single pair of molds or dies that part perpendicular to the central plane. In operation, the cylinder bore is contacted not only by the outboard outer surfaces of the outer and inner segments, but also by the symmetrical side edges of the wing member. Therefore, much more of the total potential cylindrical contact envelope is used, in a piston that is still light and strong, as well as relatively easy to manufacture.

DESCRIPTION OF THE PREFERRED EMBODIMENTS

The present invention will now be described, by way of example, with reference to the accompanying drawings, in which.

Figure 1:
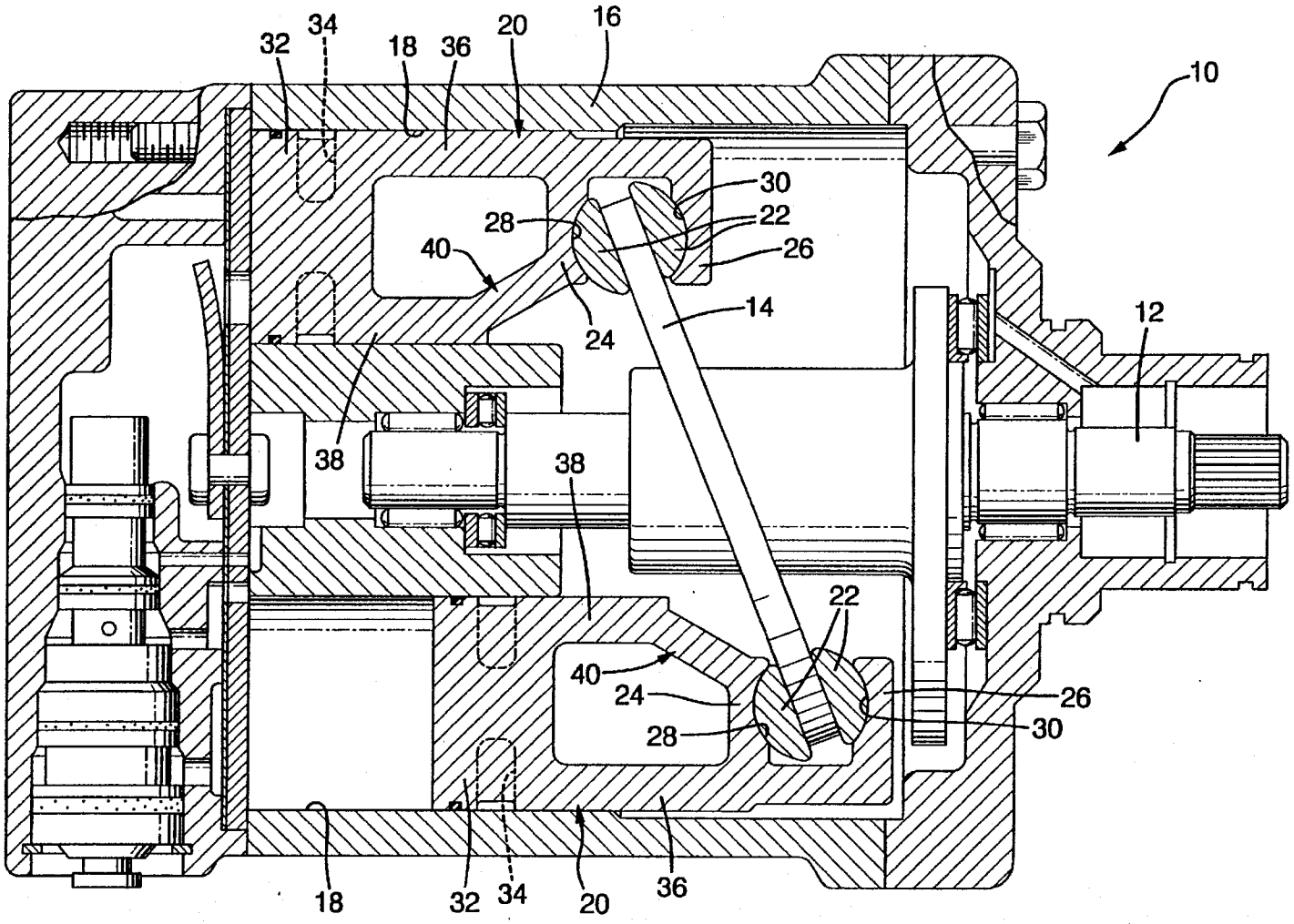
FIG. 1 is a cross section of a compressor and cylinder block, with the drive shaft and swash plate shown in elevation.

Referring first to FIG. 1, an automotive air conditioning compressor of the swash plate type is indicated generally at 10. Compressor 10 has a central drive shaft 12 with which a conventional slanted swash plate 14 that rotates therewith. Shaft 12 rotates within a cast cylinder block 16, in which a circular array of cylinder bores 18 is formed. Each bore 18 contains a piston, indicated generally at 20, which is reciprocated back and forth by plate 14 as shaft 12 rotates. As such, each piston 20 is connected to the edge of plate 14 by a pair of ball shoes 22 that allow a relative sliding and twisting action. In FIG. 1, the piston 20 shown at the top is at the forward most position of its stroke, the so called top dead center position, and the opposed piston 20 at the bottom or "6 o'clock" position is at full backstroke. Piston 20 is specially designed so as to make good, even supporting contact with the cylindrical inner surface of bore 18, and yet still be one piece, integral, light weight, and easy to manufacture.

Figure 2:
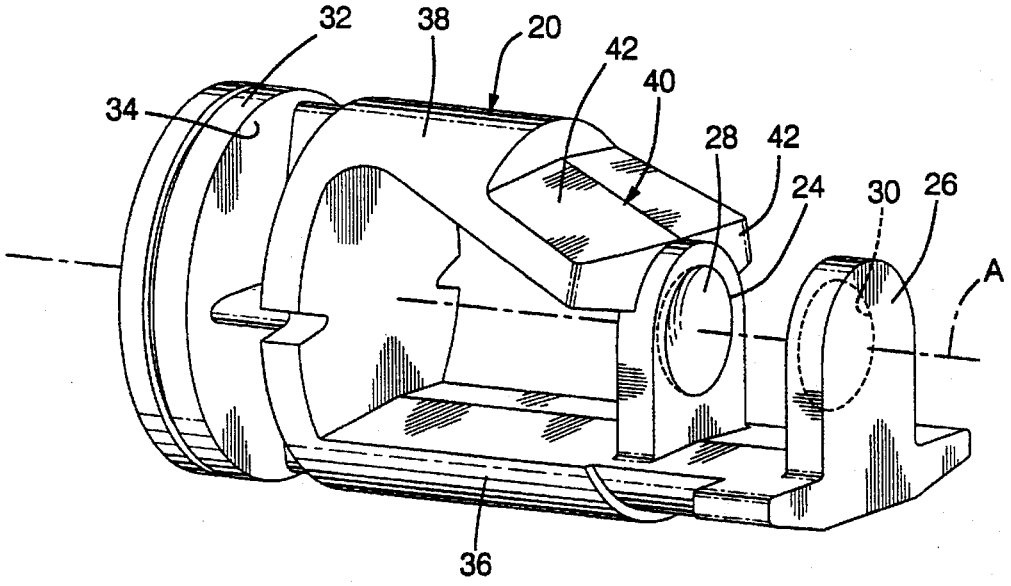
FIG. 2 is a perspective view of a preferred embodiment of a piston according to the invention, a piston found at the lowermost position of FIG. 1.
Figure 8:
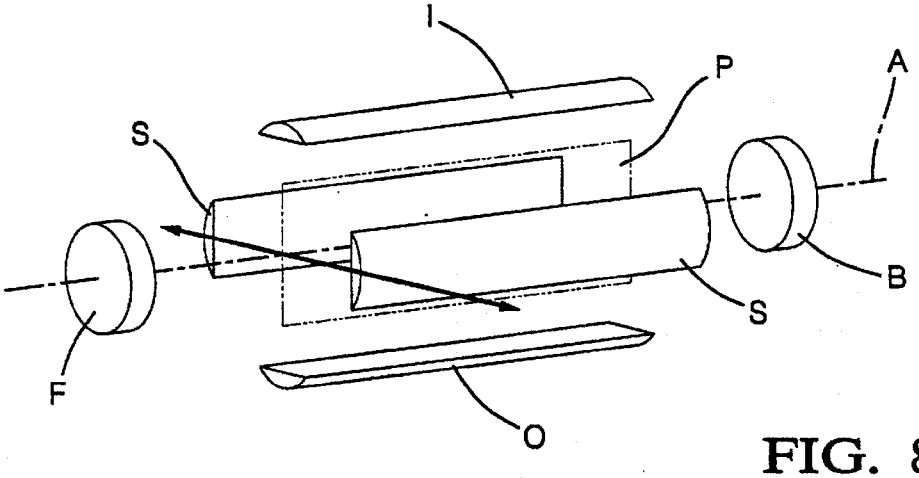
FIG. 8 is a schematic representation of the cylindrical envelope occupied by various surfaces of the piston.

Referring next to FIGS. 2 and 8, a piston 20 is depicted, which, in terms of spatial orientation, would be the piston 20 found at the lowermost or "6 o'clock position within the cylinder block 16, although all the pistons 20 have the same shape and size. In the embodiment disclosed, each piston 20 is a solid aluminum alloy piece that is die cast or forged to near net shape, after which those outboard outer surfaces that will be in actual contact with the inner surface of a bore 18 are machined to final shape and surface quality. Piston 20 has a center axis A that is the same as the theoretical axis A shown in FIG. 8, and may be considered to be bisected by the same plane P. At the very back of piston 20, a pair of parallel stanchions 24 and 26 are machined with a pair of opposed, semi spherical sockets 28 and 30, which accommodate the ball shoes 22. Relative to the arrow in FIG. 8, the sockets 28 and 30 represent an inevitable concavity. That is, there would be no conceivable way to form the sockets 28 and 30, even to a near net shape, as part of a forming process in which a single pair of tools moved together and apart in the direction of the same arrow, or any other single straight line direction. This is because the tool surface necessary to create the sockets 28 and 30 would have to be convex, which would prevent straight line withdrawal of the tools. Consequently, the sockets 28 and 30 would have to be machined out, in any piston design. However, the rest of piston 20 is designed to be easily cast by a single pair of molds, as will be evident in later description.

Figure 3:
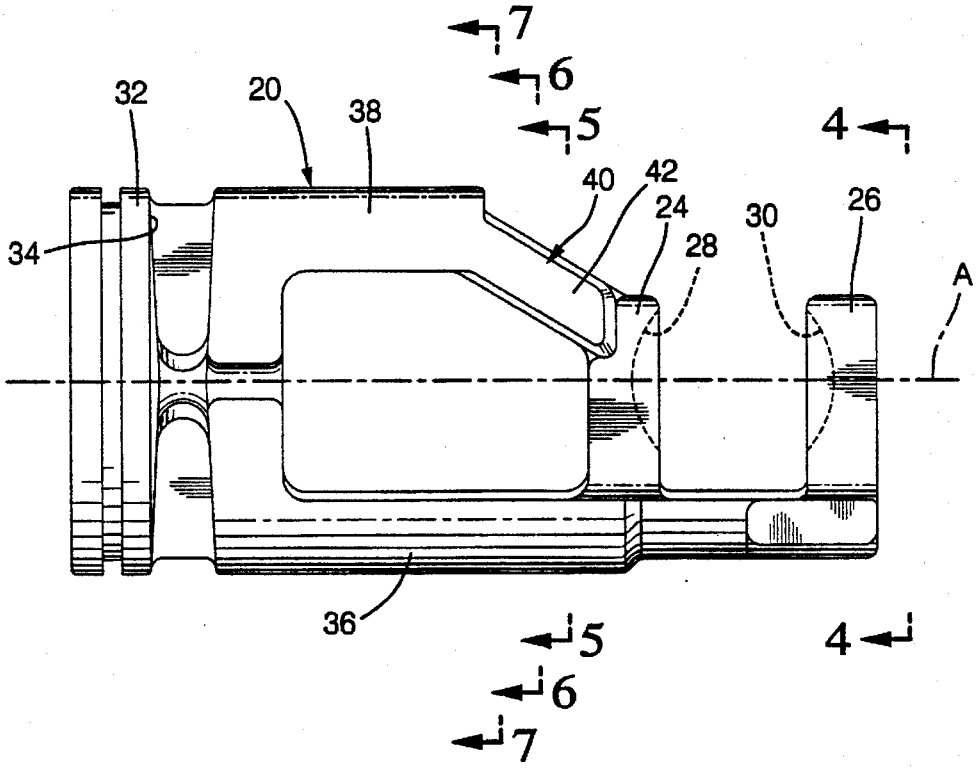
FIG. 3 is a side view of the piston.
Figure 4:
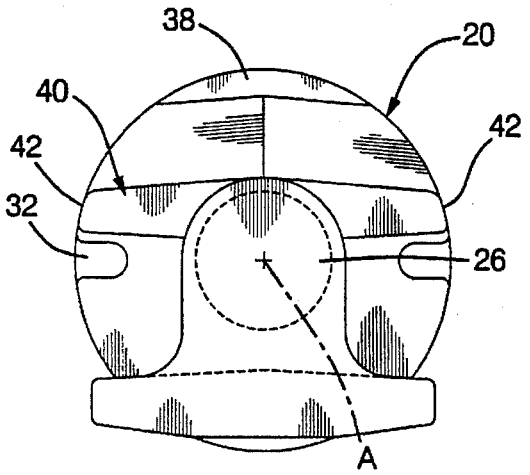
FIG. 4 is an end view of the piston from the perspective of the plane through line 4—4 in FIG. 3.

Referring next to FIGS. 2, 3 and 8, piston 20, though one piece and basically solid, can be conceptualized as a series of segments that have a certain relationship to the portions of the theoretical envelope as defined in FIG. 8 above. First, as any piston must, piston 20 has a cylindrical head 32, which is actually two short cylindrical rings, since it is bifurcated by a deep relief notch at 34. However, head 32 is still relatively axially short, compared to the overall length of piston 20, as measured from the front surface of the head 32 to the forwardmost one of the stanchions 24. The outer surface of piston head 32 makes full 360 degree contact with the inner surface of bore 18, as it must in order to be capable of compression. The rest of the body of piston 20 does not, but makes more contact, and more even contact, with the inner surface of bore 18 than has been the case with other solid, integral pistons. Extending integrally back from head 32, all the way to and integral with the forwardmost stanchion 24, is an outer semi-cylindrical segment 36. The outboard outer surface of outer segment 36 is coincident with the outer portion O of FIG. 8. The inboard outer surface of outer segment 36 is substantially flat, and has no concavity, relative to the direction of the arrow in FIG. 8. Consequently, a cross section through the outer segment 36, taken normal to the axis A, would be comprised of both an arc and a chord (or near to a chord) of a circle that is substantially equal in diameter to the bore 18. The edge to edge width of outer segment 36, as measured perpendicular to plane P, is constant. Now, the are of segment 36, while coincident with the outer envelope portion O, may subtend somewhat more or less than exactly 90 degrees, but not much more, since extra arc length would increase the greatest radial thickness of the segment 36 ( by which is meant its thickness as measured along or parallel to the central plane P). Extra thickness translates to extra mass and weight. Those conversant in plane geometry and simple trigonometry will recognize that if the outer segment 36 is limited to an arc length of about 90 degrees, then even its very greatest radial thickness (which is right on the central plane P) will only be about a third of the radius of piston 20. Therefore, there is more of the body of piston 20 that is truly hollow, meaning, as seen from the perspective of FIG. 3, simply not there. Conceptualized somewhat differently, the thickness of outer segment 36 is, everywhere, substantially less than the total radius of piston 20 (meaning the radius of head 32). If, instead, there were a web of solid material in piston 20 that extended all the way across the central plane P, as in prior "solid" pistons, then the greatest thickness of outer segment 36 would be exactly equal to the total radius of piston 20, adding considerable mass and weight. This same general pattern of semi cylindrical segments with arcuate, outboard outer surfaces that are in contact with bore 18, but with flat inboard outer surfaces, and limited thickness to reduce mass, is followed in the rest of piston 20.

Still referring to FIGS. 2, 3 and 8, piston 20 also has a semi-cylindrical inner segment 38 that extends axially back from head 32, the outboard outer surface of which is substantially coincident with the inner envelope portion I. As with outer segment 36, the inboard outer surface of inner segment 38 is also substantially flat, and its edge to edge width is substantially constant. Unlike outer segment 36, however, inner segment 38 terminates axially short of the stanchion 24. Instead, a wing member 40 extends axially and radially toward the outer segment 36, eventually merging with the forwardmost stanchion 24, and thereby being (indirectly) integral to the outer segment 36. The integral, interconnected nature of the head 32, the two segments 36 and 38, and the wing member 40 creates, in effect, a four sided, frame like structure of superior strength, as best seen in FIG. 3. Several structural features of the wing member 40 should be noted. Like the outer segment 36, it has a substantially flat inboard outer surface, but its outboard outer surface is also flattened off, rather than arcuate. Therefore, wing member 40 has a radial thickness that is rendered even smaller, as measured along the plane P. Most importantly, the side edges 42 of wing member 40 are coincident with the side portions S of the envelope shown in FIG. 8. Consequently, the edge to edge width of wing member 40 would not be a constant, but would widen moving toward the stanchion 24. Despite the fact that the wing member edges 42 do overlap the side portions S of the envelope, piston 20, as viewed in FIG. 3, is truly hollow. That is, as one moves along the arrow of FIG. 8, in the empty space bounded by all of the inboard outer surfaces of the various segments and parts of the piston 20 (32, 36, 40, 24 and 38 ), no solid material, such as a slid web lying on the plane P or a complete side wall lying on S, is encountered. Furthermore, no concavity is encountered, apart from the inevitable sockets 28 and 30. Stated differently, but for the sockets 28 and 30, all of the outer surfaces of the various piston parts and segments (24, 26, 32, 34, 36, 38 and 40), are, from the perspective of the arrow in FIG. 8, either convex or, at worst, flat. What this means is that not only may the piston 20 be solid and integral, it can be formed, either die cast or forged, by a single pair of forming elements, such as molds of dies. A pair of molds, for example, could move together and apart along the double headed arrow of FIG. 8, abutting and closing off right on the central plane P of FIG. 8. This would leave a parting line, but no solid web, fight on that same central plane P. That is a great manufacturing advantage, since only the sockets 28 and 30 will thereafter have to be machined out, although all rubbing surfaces will have to be machined to a final smoothness, which would be true for any design.

Figure 5:
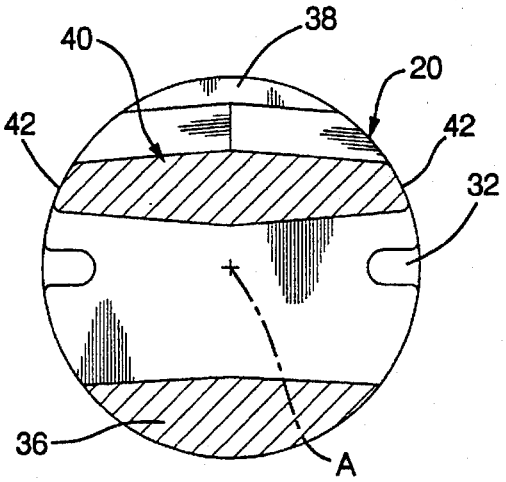
FIG. 5 is a cross section of the plane through the line 5—5 of FIG. 3.
Figure 6:
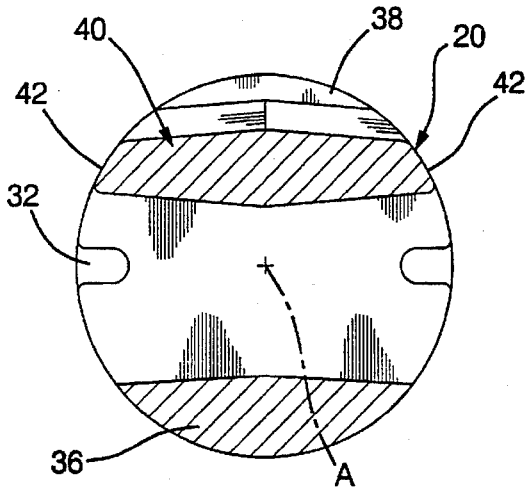
FIG. 6 is a cross section of the plane through the line 6—6 of FIG. 3.
Figure 7:
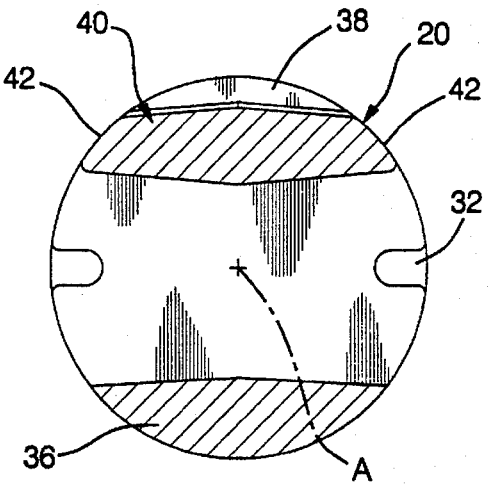
FIG. 7 is a cross section of the plane through the line 7—7 of FIG. 3.

Referring next to FIGS. 1 and 4–7, the shape of piston 20 described yields operational advantages in addition to ease of manufacture. Unlike many other one piece designs, piston 20 does have effective, bore contacting side surface area, that being the wing member side edges 42. As best seen in FIGS. 5 through 7, wherever the wing member 40 is cross sectioned, part of the side edges 42 reside where they can make supportive, guiding contact with the inner surface of the cylinder bore 18, coincident with the envelope side portions S. Such side support is potentially important when the piston 20 sees high side loads, which can occur as piston 20 is approaching or leaving its top dead center position. Moreover, unlike other one piece designs, the areas of side contact with the bore 18 are symmetrical, and not all on one side or the other, so the piston 20 is evenly supported within bore 18. The structural member needed to provide the side supporting edges 42, the wing member 40, is not relatively thick, does not add a great deal of weight, and does not jeopardize the hollow, light weight nature of the piston 20. That is, no solid material, except that located directly inboard of the side edges 42 themselves, is "seen", either literally by an observer, or figuratively by a moving mold, as piston 20 is viewed from the side. In addition, the wing member 40, by merging with the forwardmost stanchion 24, adds to the structural strength and integrity of piston 20. In conclusion, then, a solid but effectively hollow symmetrically side supported piston 20 is provided.

Variations in the embodiment disclosed could be made. The inboard outer surfaces of the main segments 36 and 38 would not necessarily have to be left flat, they could be machined out later to a concave shape, reducing thickness and weight even more, if desired. That is an extra process step that might not be worth the cost, however. The wing member 40 could, if desired, be directly integral with the head 32, and extend axially straight back therefrom, parallel to and between the inner and outer segments 36 and 38. In that case, the back ends of both the inner segment 38 and the straight wing paralleling it would be made integral to the forwardmost stanchion 24, for stability and strength. The point of integration between the stanchion 24 and any other part of piston 20, while having a structural purpose, would not enter the piston bore 18 to any significant extent, even on full stroke, and would thus not be given any machined outer surface intended to ride on the inner surface of bore 18. The wing member 40 could extend radially farther than shown, that is, it could wrap all the way out to the outer piston segment 36. The side edges 42 would thereby coincide with a full 90 degrees of the theoretical envelope side portions S, rather than just with the 45 degree halves thereof that lie closest to the piston inner segment 38. However, it is in that area closest to the piston inner segment 38 that side support is felt to be more important. Or, on the other hand, the wing member side edges 42 could cover less of the side portions S than shown, being cut back to save weight, in an application where less side support for piston 20 was needed. The end of the wing member 40 need not merge directly with any other part of piston 20, either directly with the outer segment 36, or with the forwardmost stanchion 24. Instead, the wing member 40 could terminate near the back of piston 20, creating, in effect, only a three sided structure, rather than a four sided, completely interconnected frame. However, the frame like configuration shown adds extra strength with little extra weight, and does nothing to jeopardize formability or moldability. The outboard outer surface of the wing member 40 need not be flattened off, as shown, from a manufacturing standpoint. It could be left semi cylindrical, as an extension of the outboard outer surface of the outer segment 36. However, that extra cylindrical outer surface would simply coincide with the back portion B of the theoretical surface envelope, which is not as important to piston support, and would also add extra thickness and weight. Therefore, it will be understood that it is not intended to limit the invention to just the embodiment disclosed.

We claim:

1. An integral piston (20) for use in an air conditioning compressor (10) having cylinder bores (18) arrayed in a circular pattern around a generally cylindrical cylinder block (16), in which a piston (20) is reciprocated back and forth in each cylinder bore (18) with close sliding contact between said piston (20) and cylinder bore (18), and in which said piston (20) has a cylindrical outer envelope comprised of a front end (F), a back end (B), a semi cylindrical outer surface portion (O) facing radially outwardly of said cylinder block (16), a semi cylindrical inner surface portion (I) and two semi cylindrical side surface portions (S), said inner (I) and outer (O) surface portions being bisected by a central plane (P) through a central axis (A) of said piston (20), said piston (20) comprising, a relatively short cylindrical head (32) at the front end (F) of said envelope having a continuous annular outer surface in full contact with said cylinder bore (16), an outer semi cylindrical segment (36) integral with and extending axially along said piston (20) and having an outer surface coincident with said outer surface portion (O) of said envelope and having a greatest radial thickness that is everywhere substantially less than the radius of said piston head (32), an inner semi cylindrical segment (38) integral with and extending axially of said piston (20) and having an outer surface coincident with said inner surface portion (I) of said envelope and having a radial thickness comparable to said outer semi cylindrical segment (O), and, a wing member (40) integral with and extending axially of said piston (20) said wing member (40) having a radial thickness that is every where substantially less that the radius of said piston head (32) and side edges (42) symmetrically coincident with at least part of each of said envelope side surface portions (S), whereby, said piston (20) is evenly supported within said cylinder bore (16) by outer surfaces that lie on all four portions (O, I, S) of said envelope, but no piston material is encountered between said piston segments (36, 38) and wing member (40) moving in a direction generally perpendicular to said central plane (P), thereby reducing piston weight.

2. An integral piston (20) as described in claim 1, further characterized in that, said wing member (40) is integral with and extends axially back and radially outwardly from said inner semi cylindrical segment (38).

3. An integral piston (20) as described in claim 2, further characterized in that, said wing member (40) extends axially back and radially outwardly from said inner semi cylindrical segment (38) toward and integrally into said outer segment (36), whereby, a generally four sided structure is created.

* * * * *